US010487506B2

(12) United States Patent
Thornton et al.

(10) Patent No.: US 10,487,506 B2
(45) Date of Patent: Nov. 26, 2019

(54) TIMBER JOIN

(71) Applicants: Andrew Thornton, Oak Flats (AU); James Thornton, Oak Flats (AU)

(72) Inventors: Andrew Thornton, Oak Flats (AU); James Thornton, Oak Flats (AU)

( * ) Notice: Subject to any disclaimer, the term of this patent is extended or adjusted under 35 U.S.C. 154(b) by 0 days.

(21) Appl. No.: 16/068,813

(22) PCT Filed: Dec. 23, 2016

(86) PCT No.: PCT/AU2016/051285

§ 371 (c)(1),
(2) Date: Jul. 9, 2018

(87) PCT Pub. No.: WO2017/117622

PCT Pub. Date: Jul. 13, 2017

(65) Prior Publication Data

US 2019/0010701 A1 Jan. 10, 2019

(30) Foreign Application Priority Data

Jan. 7, 2016 (AU) ..... 2016900043

(51) Int. Cl.
*E04C 3/14* (2006.01)
*E04C 3/29* (2006.01)
(Continued)

(52) U.S. Cl.
CPC ..... *E04C 3/14* (2013.01); *E04C 3/12* (2013.01); *E04C 3/291* (2013.01); *E04C 3/292* (2013.01); *E04C 3/36* (2013.01)

(58) Field of Classification Search
CPC ..... E04C 3/12; E04C 3/14; E04C 3/29; E04C 3/291
See application file for complete search history.

(56) References Cited

U.S. PATENT DOCUMENTS 3,791,082 A * 2/1974 Bowling ..... E04C 3/14 52/592.1
4,191,000 A * 3/1980 Henderson ..... E04C 3/14 144/371

(Continued)

OTHER PUBLICATIONS

International Search Report dated Mar. 22, 2017 for corresponding International Patent Application PCT/AU2016/051285 filed on Dec. 23, 2016.

(Continued)

*Primary Examiner* — Andrew J Triggs
(74) *Attorney, Agent, or Firm* — David D. Brush; Westman, Champlin & Koehler, P.A.

(57) ABSTRACT

A join is provided for end-joining elongate timber flanges. The join includes: an elongate planar web having an upper portion running along the longitudinal axis, and a lower portion running along the longitudinal axis; the elongate planar web having, in order running along the longitudinal axis, a first region, a second region and a third region, the second region having a greater width than the first and third regions; and a first elongate timber flange having a slot engaging upper portions of the first and second regions of the planar web; a second elongate timber flange have a slot engaging the upper portions of the second and third regions of the planar web. The lower edge of the planar web extends beyond the edge of the first and second elongate timber flanges so as to provide an engagement point for a further elongate timber flange.

19 Claims, 7 Drawing Sheets

(51) Int. Cl.

| | |
|---|---|
| ***E04C 3/12*** | (2006.01) |
| ***E04C 3/36*** | (2006.01) |
| ***E04C 3/292*** | (2006.01) |

(56) References Cited

U.S. PATENT DOCUMENTS

| | | | | |
|---|---|---|---|---|
| 4,336,678 | A | 6/1982 | Peters | |
| 4,509,571 | A | 4/1985 | Peters | |
| 4,677,806 | A * | 7/1987 | Tuomi | E04B 1/26 403/382 |
| 4,852,322 | A * | 8/1989 | McDermid | E04C 3/14 52/404.3 |
| 5,761,872 | A * | 6/1998 | Sanford | E04C 3/16 52/694 |
| 6,012,262 | A * | 1/2000 | Irving | E04C 3/14 52/837 |
| 6,343,453 | B1 * | 2/2002 | Wright | E04C 3/14 52/837 |
| 6,701,690 | B2 * | 3/2004 | Deschenes | E04C 3/16 52/837 |
| 8,910,455 | B2 * | 12/2014 | Yang | E04C 3/292 29/428 |
| 9,631,366 | B2 * | 4/2017 | Mei | E04B 5/12 |
| 2011/0113725 | A1 * | 5/2011 | Garry | B21D 47/01 52/838 |

OTHER PUBLICATIONS

Written Opinion of the International Searching Authority dated Mar. 22, 2017 for corresponding International Patent Application PCT/AU2016/051285 filed on Dec. 23, 2016.

* cited by examiner

TIMBER JOIN

The present application is a Section 371 National Stage Application of International Application No. PCT/AU2016/051285, filed Dec. 23, 2016, which is incorporated by reference in its entirety and published as WO 2017/117622 A1 on Jul. 13, 2017, in English.

FIELD OF THE INVENTION

The present invention is directed to the field of construction, and in particular building construction. Included within the present invention are structural timber members capable of bearing loads required in applications such as bearers, floor joists, roof rafters, beams, columns and the like.

BACKGROUND TO THE INVENTION

Timber is a commonly utilized material in building construction, and is often used in load bearing applications. The refined microstructure of wood provides a low weight but excellent load bearing capacity. Despite its low weight, wood has a strength 14 times that of steel.

For load bearing uses in construction, wood is chosen for a given application according to a minimum modulus of elasticity (MOE) which is a measure of stiffness, and in turn strength of a beam. The MOE for a timber varies according a number of factors, however the main factor being the wood species. The load bearing capacity of a timber beam is a function of the physical dimensions of the beam, as well as the MOE. Beams of high cross-sectional area sawn from hardwood species are typically chosen to high load bearing applications.

Timber beams capable of bearing significant load are expensive. For reasons of economy, the prior art provides many techniques by which wood members may be laminated together to provide a composite timber joist. Techniques for end-joining to provide timber joists of the required span are also known. Such techniques allow for the use of timbers having smaller-cross sectional areas, and shorter spans (such as "peeler cores") to be used in constructing higher value structural beams. Some problems in these prior art approaches derive from the need to both laminate timber together to increase cross-sectional area and also incorporate means for joining timbers end-to-end. End-joining techniques using dowels are typically used, however careful placement of dowels is required so as so not interfere with the lamination means used. Even where care is taken, the combination of lamination and end-joining can lead to areas or points of potential failure.

It is an aspect of the present invention to ameliorate or overcome a problem of the prior art by providing improved means for laminating and end-joining timbers to provide high value timber timber joists. It is a further aspect to provide an alternative to prior art means.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not necessarily the broadest aspect, the present invention provides a join for end-joining elongate timber flanges, the join comprising:

an elongate planar web having an upper portion running along the longitudinal axis, and a lower portion running along the longitudinal axis;

the elongate planar web having, in order running along the longitudinal axis, a first region, a second region and a third region, the second region having a greater width than the first and third regions;

a first elongate timber flange having a slot engaging upper portions of the first and second regions of the planar web;

a second elongate timber flange have a slot engaging the upper portions of the second and third regions of the planar web;

wherein the lower edge of the planar web extends beyond the edge of the first and second elongate timber flanges so as to provide an engagement point for a further elongate timber flange.

In one embodiment of the join, the second region is formed so as to provide a tab extending from the upper edge of the elongate planar web.

In one embodiment of the join, the second region extends greater than about 50% into the first and/or second elongate timber flanges In one embodiment of the join, the second region extends substantially completely through the first and/or second elongate timber flanges In one embodiment of the join, the first region extends at least about 10% into the first elongate timber flange, and the second region extends at least about 10% into the second elongate timber flange.

In one embodiment of the join, the first region extends up to about 50% into the first elongate timber flange, and the second region extends up to about 50% into the second elongate timber flange.

In one embodiment of the join, the longitudinal axes of the planar web, the first elongate timber flange and the second elongate timber flange are substantially parallel.

In one embodiment of the join, the opposing ends of the first and second elongate planar flanges abut within the lateral borders of the second region of the elongate planar web.

In one embodiment of the join, the abutment is along a substantially central point of the second region of the elongate planar web.

In one embodiment of the join, the slot is dimensioned so as to make close connection with the elongate planar web.

In one embodiment, the join comprises a third elongate timber flange having a slot engaging a lower portion of the first, second and third regions of the planar web.

In one embodiment of the join, a substantially central region of the third timber flange is coincident with a substantially central point of the second region of the elongate planar web.

In one embodiment of the join, the planar web extends at least about 10% into the third timber flange.

In one embodiment of the join, the planar web extends up to about 50% into the third timber flange.

In one embodiment of the join, the first timber flange does not abut the third timber flange, and the second timber flange does not abut the third timber flange so as to leave a portion of the elongate planar flange exposed.

In one embodiment of the join, the area of the exposed portion of the elongate planar flange is less than about 50% of the total area of the elongate planar flange.

In one embodiment of the join, the first timber flange, the second timber flange, and the third timber flange (where present) are substantially circular in cross-section.

In one embodiment of the join, the first timber flange, the second timber flange, and the third timber flange (where present) are timber rounds.

In one embodiment of the join, the first timber flange, the second timber flange, and the third timber flange (where present) are peeler cores.

In one embodiment of the join, the elongate planar web is fabricated from a timber ply material.

In a second aspect, the present invention comprises a timber joist comprising:

an elongate planar web having an upper portion running along the longitudinal axis, and a lower portion running along the longitudinal axis;

the elongate planar web having, in order running along the longitudinal axis, a first region, a second region and a third region, the second region having a greater width than the first and third regions;

an upper elongate timber flange having a slot engaging upper portions of the first, second and third regions of the planar web; and a lower elongate timber flange have a slot engaging the lower portions of the first, second and third regions of the planar web;

In one embodiment of the join, the second region is formed so as to provide a tab extending from the upper edge of the elongate planar web.

In one embodiment of the joist, the second region extends greater than about 50% into the first and/or second elongate timber flanges In one embodiment of the joist, the second region extends substantially completely through the first and/or second elongate timber flanges In one embodiment of the joist, the first region extends at least about 10% into the first elongate timber flange, and the second region extends at least about 10% into the second elongate timber flange.

In one embodiment of the joist, the first region extends up to about 50% into the first elongate timber flange, and the second region extends up to about 50% into the second elongate timber flange.

In one embodiment of the joist, the longitudinal axes of the planar web, the first elongate timber flange and the second elongate timber flange are substantially parallel.

In one embodiment of the joist, the slot is dimensioned so as to make close connection with the elongate planar web.

In one embodiment of the joist, the first timber flange does not abut the second timber flange, so as to leave a portion of the elongate planar flange exposed.

In one embodiment of the joist, the area of the exposed portion of the elongate planar flange is less than about 50% of the total area of the elongate planar flange.

In one embodiment of the joist, the first timber flange and the second timber flange are substantially circular in cross-section.

In one embodiment of the joist, the first timber flange and the second timber flange are timber rounds.

In one embodiment of the joist, the first timber flange and the second timber flange are peeler cores.

In one embodiment of the joist, the elongate planar web is fabricated from a timber ply material.

BRIEF DESCRIPTION OF THE FIGURES

FIG. 10 shows exemplary dimensions of the embodiments shown in FIGS. 1A and 1B.

DETAILED DESCRIPTION OF THE INVENTION

Figure 1A:
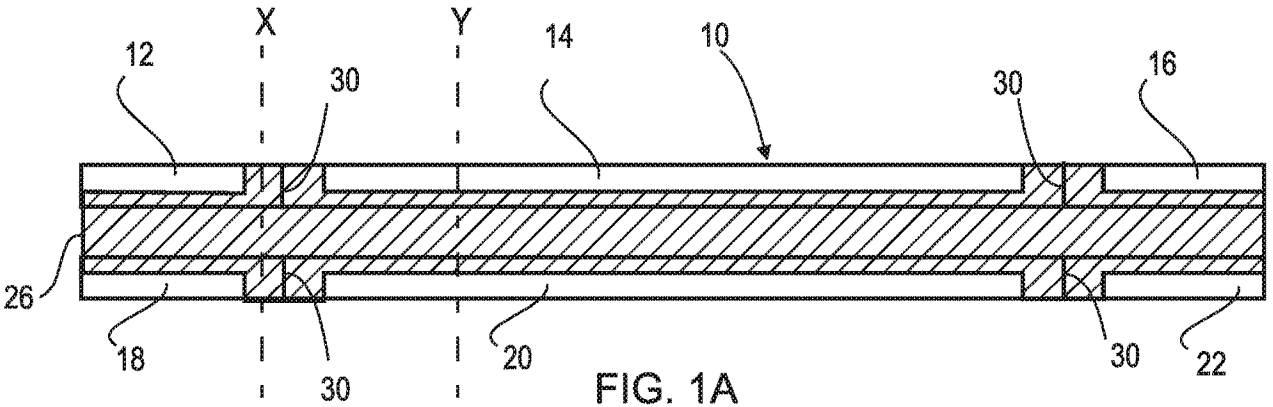
FIG. 1A shows the assembled timber joist.

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

The terms "upper", "lower", "above" and "below" are intended to refer only to the relative positions of component of the invention, and particularly with reference to orientation as shown in the drawings. It will be understood that the assembled timber joists of the invention can be installed in any orientation, and so the terms "upper" and "lower" are not restrictive on the claims.

The present invention is predicated at least in part on the finding that a web having a widened region is useful for both lamination and end-joining of timbers to form a composite timber timber joist. The web participates in a join formed by timber flanges disposed above and below the central longitudinal axis of the web, and also timber flanges disposed end-to-end. Accordingly, in a first aspect the present invention provides a join for end-joining elongate timber flanges, the join comprising:

an elongate planar web having an upper portion running along the longitudinal axis, and a lower portion running along the longitudinal axis;

the elongate planar web having, in order running along the longitudinal axis, a first region, a second region and a third region, the second region having a greater width than the first and third regions;

a first elongate timber flange having a slot engaging upper portions of the first and second regions of the planar web;

a second elongate timber flange have a slot engaging the upper portions of the second and third regions of the planar web;

wherein the lower edge of the planar web extends beyond the edge of the first and second elongate timber flanges so as to provide an engagement point for a further elongate timber flange.

While not so limited, the present invention is particularly amenable to the use of peeler cores as flanges, so as to overcome the natural limitation to lengths of about 2400 mm. The invention is further amenable to use with small diameter perfect round timber flanges which are typically limited to a maximum length of about 3600 mm by the nature of the resource.

The widened regions of the web may, in some embodiments, take advantage of increasing the adhesive surface area of the web at the butt joining of the log flange ends so as to improve resistance to compression forces on the upper side of the composite member and tension forces along the lower side.

The extra laminated areas provided the widened region of the web may be considered to function as a spacer or cushion along the upper flange butt joins where upper options of the widened region resist compression forces along the top, and low portions resist tension forces along the lower side of the composite member where they provide an anchor function.

The use of the web having a widened region may provide for decreased twisting or displacement at central regions of the composition timber joist, or at regions bearing particularly high loads. This resistance to deformation may obviate or at least decrease the need for supporting the timber joist by blocking.

The widened region of the web may further allow for lesser normal laminated glue embedment of the web along the whole lengths of the flanges and therefore significant cost savings.

The elongate planar web is typically fabricated from a sheet-like material of sufficient strength to provide an advantage. In one embodiment of the join, the web is formed of a relatively high strength planar material, the material selected form the group of: timber, processed timber; chipboard, plywood, metal sheet, metal plate, fibre reinforced cement sheet, plastic, and fibre reinforced plastic material.

In one embodiment of the timber joist, flanges are parallel to each other and the web is of elongate rectangular shape.

The second region of the web has a width greater than adjacent first and third regions. The widening of the second region may be effected by any extension, protrusion, evagination or similar of the web. Typically, the widening is not a widening of the thickness of the planar web, but instead in the width of the web when considered in plan view.

Widening of the second region may be formed by a structure such as a tab of any kind. The tab may extend from an upper or a lower edge of the web, and in some embodiments from both upper and lower extensions of the web. In one embodiment, opposed tabs extend from the upper and lower edges of the web.

Generally, the tab has a geometrically regular shape. In one embodiment, the tab has an outermost edge which is substantially parallel to the longitudinal axis of the web. Generally, when the tab extends completely though the flange, the tab is configured such that the outmost edge sits flush with the surface of flange.

In one embodiment, the web (including the widened region) is unitarily formed, this providing a more resilient structure.

In one embodiment of the join, the web (in the first and/or second regions) extends to a depth of at least about 21%, 22%, 23%, 24%, 25%, 26%, 27%, 28%, 29% or 30% the diameter of the flange into which it is embedded.

In another embodiment, the web (in the first and/or second regions) extends to a depth of at least about 31%, 32%, 33%, 34%, 35%, 36%, 37%, 38%, 39%, 40%, 41%, 42%, 43%, 44%, 45%, 46%, 47%, 48%, 49%, or 50% the diameter of the pole into which it is embedded. In one embodiment, the web extends along a radial line and to the axial centre of the flange.

In the second (widened) region, the web may extend to a depth of at least about 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, 100% the diameter of the pole into which it is embedded. In one embodiment, the web extends along a radial line and to the axial centre of the flange.

The flanges may be formed from any elongate timber member, including members having a cross-section which is substantially circular, rectangular, square, triangular, hexagonal, and octagonal. Advantageously, the flange may be a timber round. Timber rounds are described in Section 6 of Australian Standard 1720, and are typically produced from softwood trees grown commercially as renewable forest plantation timber. These timbers are typically fast growing, easily harvested, and have a low natural defect rate.

Various species of timber are suitable to form the true rounds, particularly those types of species that tend to have a relatively constant diameter for a considerable portion of their length to minimise waste during the trimming and circularising processes. Plantation pine materials, such as slashpine or *Carribaea* hybrids, tend to form suitable true rounds. Other materials that might be considered include Douglas fir, and various eucalypt species.

True rounds are particularly strong since the natural strength of the timber fibres is not disrupted by sawing or other treatment. The integrity of the round is maintained, and the trimming process required to circularise the round does not greatly affect the overall strength of the round. The natural characteristics of timber are that the central core or pith of the round is relatively soft and has low structural strength. The periphery of the timber, on the other hand, is much harder and the timber fibres are able to carry a high tensile load. Also, this hard outer layer is more resistant to water absorption and attack by insects, and thus by keeping the outer circumference of the timber largely intact in the process of preparing a true round, the structural integrity of the timber is maintained The rounds in some forms of the invention do not strictly conform to Australian Standard 1720, and may be of a smaller diameter such that the Standard is not satisfied. However, by the fastening of at least three rounds together a required load bearing capacity may be nevertheless attained.

In one embodiment, the flange (and particularly where the flange is a timber round) has a diameter of less than about 125 mm, or about 100 mm, or about 75 mm, or about 70 mm, or about 65 mm, or about 60 mm, or about 55 mm, or about 50 mm, or about 45 mm, or about 40 mm. In another embodiment, the timber round, has a diameter of less than about 60 mm.

The flange may be pole in some embodiments. The term "pole" as used herein is intended to mean a naturally occurring round cross-section pole having a central core and having had its peripheral surface trimmed so that the pole has a substantially constant cross-sectional shape along its full length. Suitable poles include true round plantation pine, such as slashpine or *Carribaea* hybrids, or other timber species.

In some embodiments, the rounds are "peeler cores". As is understood by the skilled person, a peeler core is a round pressure treated post. A peeler core has been turned in a milling machine to the point that substantially all the soft wood has been removed (for plywood manufacturing), leaving the hardwood core which is typically dense and inflexible. The milling process peels off the bark, cambium layer, sapwood, and even some of the heartwood to make veneer panels. This leaves no sapwood on the post.

The hardwood core of a peeler core does not absorb the pressure treatment and preservatives as well as the softwood resulting in an inferior post that will typically not last as long as a post with treated softwood on the exterior.

Applicant has discovered an economically and technically viable use for peeler cores in that the cores may be used in a composite timber product such as that disclosed herein. The use of multiple peeler cores (and even those with a diameter down to about 70, 60, 50 or 40 mm) can produce a member which is useful in construction and yet is highly cost-effective.

It has been surprisingly found that even smaller diameter rounds (of between about 40 mm to about 60 mm, such as peeler cores) may be used to fabricate useful timber structural members. The resultant composite structural members may be used as very low cost joists. Such joists may have widths as low as 40 mm.

Once assembled, the web is typically fully embedded into the slots formed in the flange above the web, and the flange below the web. Generally, the slots are configured accommodate all regions of the web such that the flanges are separated by a fixed distance and are therefore substantially parallel. In one embodiment of the join, there is an exposed region of the web (i.e. being the region not embedded into a flange). The exposed region of the web may comprise up to about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30% the total area of the web. In other embodiments the exposed region of the web may comprise up to about 31%, 32%, 33%, 34%, 35%, 36%, 37%, 38%, 39%, 40%, 41%, 42%, 43%, 44%, 45%, 46%, 47%, 48%, 49%, or 50% the total area of the web.

In some embodiments, the flanges contact such that there is no exposed area of web. In such cases, and where the flanges are rounds, each round may have a longitudinal segment removed so as to provide a planar interface between the flanges.

Prior to joining the machined rounds to create the structural member, the rounds may be treated with a preservative to provide service life protection. Varying degrees of protection can be imparted dependent upon the intended application of the structural member. A suitable preservative may be provided by employing the process known as Ammoniacal Copper Quaternary (ACQ) which is Chromium and Arsenic free.

Typically, an adhesive is used to fix the web to the flanges. The adhesive bonding material may, for example, comprise a two component epoxy material or in some applications a single phase epoxy may be used. Ideally the epoxy completely encases the fastener, thereby providing a barrier to corrosion of the fastener along its entire length. Specifically, a suitable adhesive is a structural epoxy resin such as waterproof thixotropic solvent free epoxy resin.

The present invention is predominantly described by reference to a web joining a timber flange above the web, and a timber flange below the web to form an "I-beam" configuration in cross section. Where greater strength is required, a second web may embed underneath the lower flange, with the second web embedding into the third flange. A further, fifth, sixth, seventh, eighth, ninth or tenth flange may be further added in this way. Of course, for each further flange, a further web is required.

Without wishing to be limited by theory in any way, it is proposed that the use a higher number of flanges results in a structural member of a strength greater than simply the additive values of each individual round. Such members may be stiffer and less liable to deform or deflect than would be otherwise expected. It is thought the each added round provides a further shear face, with each added shear face provided an incremental advantage.

Given the low diameters of peeler cores, it will be appreciated that a greater number of rounds may be required to achieve any desired structural property. For example, while a structural member composed only of larger diameter rounds may only require 2 or 3 rounds, the use of peeler cores may require 4, 5, 6, 7 or 8 rounds to achieve a useful result.

The present joins may be used in the fabrication of a structural members such as a joist. Such joists may be formed into modules of 2.4 m by 2.4 m to create a very strong modular flooring system where the outside or perimeter joists of a module co-operate with the adjacent and abutting edge of a joist in a similar. In this case, modules of 2.4 m by 2.4 m can abut all the way around to another module in an additive manner except for the outside of the shape which can also benefit by laminating a further joist to it. Effectively, this new cross pinned and laminated double member joist is capable of acting as a bearer when supported at every 2.4 m and by adding an extra joist this system is reduced by that 2.4 m length of more expensive (but stronger) bearer. A further advantage is that modules can be prefabricated and delivered to site with considerable cost and time savings Optimum beam depth to span ratios generally stay true for increasing element numbers in a beam and when that beam is used as a joist it can still produce the lowest beam mass per meter per unit of load carried. Such Joists may comprise 5×50 mm rounds to provide a joist of 215 mm H, or 6×50 mm rounds to provide a joist or 210 mm H, or even a 7×40 mm rounds to provide a joist of 180 mm H.

The skilled person understands that by performing a similar analysis on a range of conformations it will be possible to effectively optimise joists based upon resource availability and beam function.

Distinct from the aforementioned embodiments directed to joins, but nevertheless reliant on a planar web having a widened region, the present invention provides a timber joist comprising:

- an elongate planar web having an upper portion running along the longitudinal axis, and a lower portion running along the longitudinal axis;
- the elongate planar web having, in order running along the longitudinal axis, a first region, a second region and a third region, the second region having a greater width than the first and third regions;
- an upper elongate timber flange having a slot engaging upper portions of the first, second and third regions of the planar web; and
- a lower elongate timber flange have a slot engaging the lower portions of the first, second and third regions of the planar web.

In this embodiment, the widened region of the planar web functions to strengthen a joist formed from two or more flanges. It will be understood that the various features of the flanges, webs and slots as described in respect of the joins of the present invention may apply also to forms of the invention that are not involved in any end-joining of flanges. For the sake of succinctness, the features will not be recited again herein, but instead are incorporated herein by reference.

The present invention will be now more fully described by reference to the following non-limiting examples.

DETAILED DESCRIPTION OF PREFERRED EMBODIMENTS OF THE INVENTION

Reference is made to the embodiments shown in the drawings, with equivalent components being marked with same numerals wherever possible. The components of the drawings are not drawn precisely to scale.

Figure 1B:
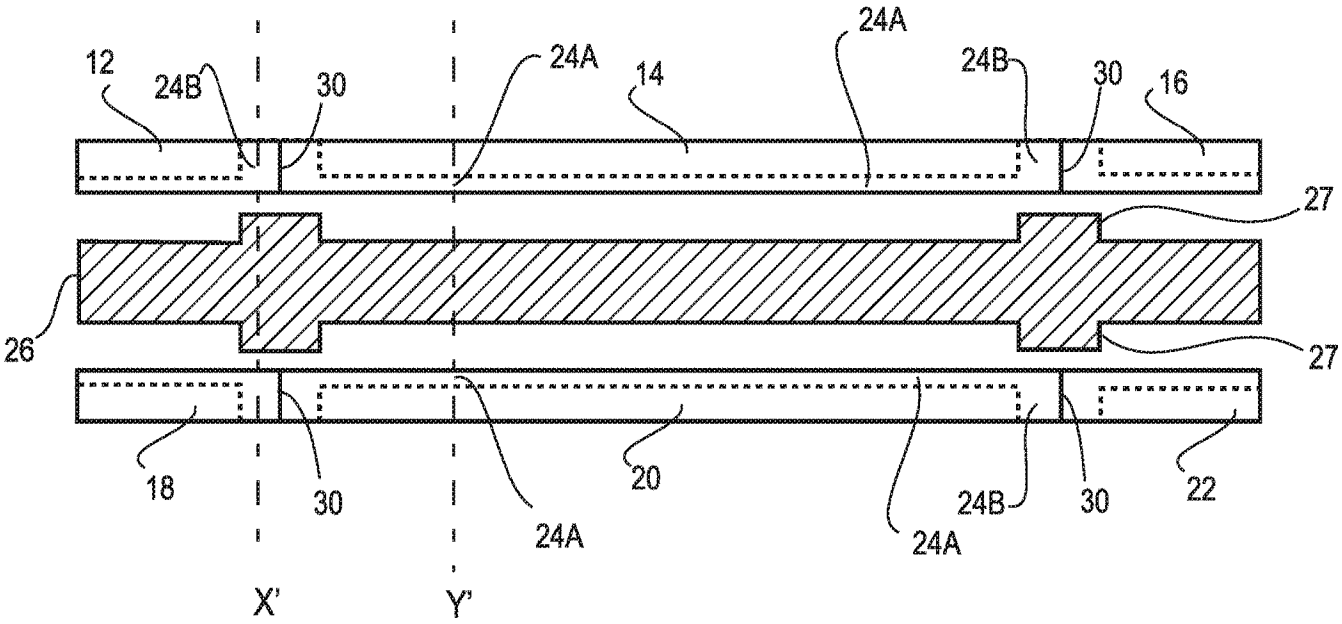
FIG. 1B shows a partially exploded view of the member of FIG. 1A, to more clearly show the shape of the planar web (cross-hatched). The widened region of the web consists of opposed upwardly and downwardly extending tabs.
Figure 1C:
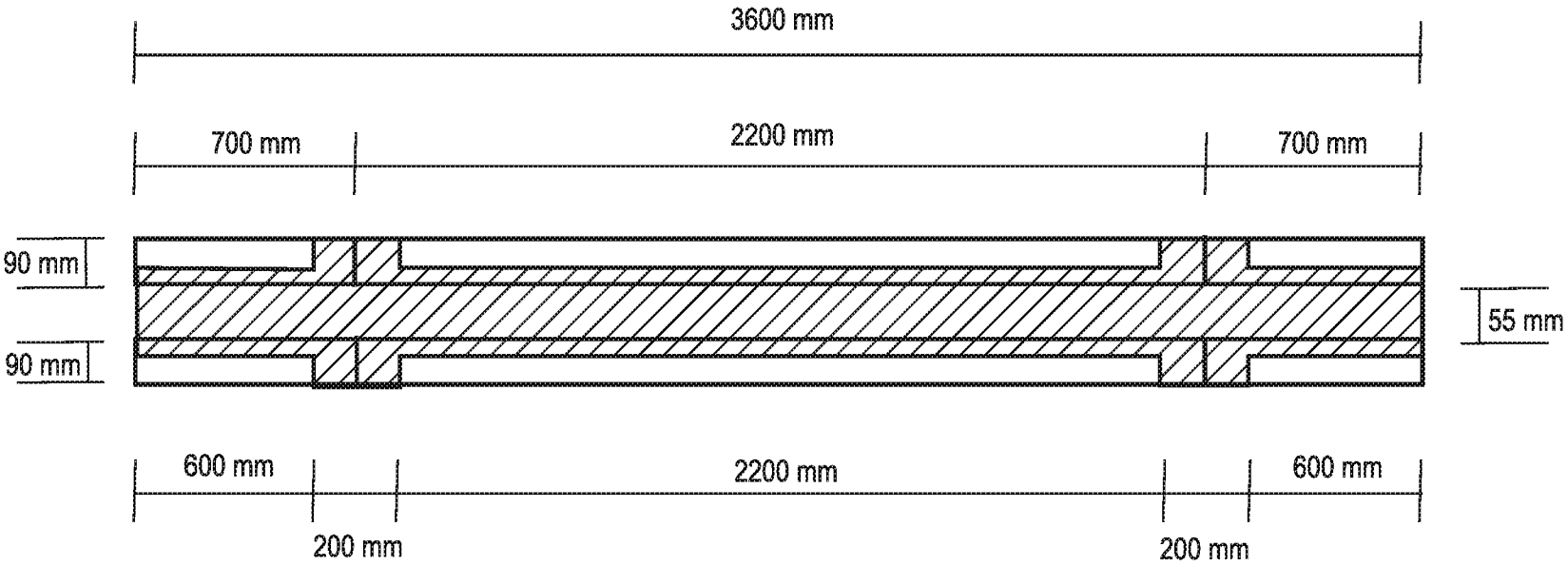
FIG. 1 shows diagrams of a composite timber joist fabricated from six timber rounds, all rounds laminated together using joins of the present invention.

Turning to a first exemplary embodiment, reference is made to FIG. 1 which shows diagrammatically a planar web 26 of unitary construction (the entirety of which is highlighted by cross hatching) as used to join four timber rounds 12, 14, 16, 18, 20, and 22. The web 2 is more clearly shown in the partially exploded view of FIG. 1B whereby the widened second region is formed by opposing tabs (two of which are marked 27). The region of the web immediately to the left of the opposing tabs 27 is a first region of the web 26, and the region immediately to the right is the third region of the web.

The timber rounds include slots configured to accept the web 26, fabricated form a single sheet of ply board in this embodiment. Above the central axis of the web 26 is first set of timber rounds 12, 14, 16 and below the axis a second set 18, 20, 22. Two types of slot are provided in each round 12, 14, 16, 18, 20, and 22: the first being shallow slots 24A and the second being deep slots 24B. In this embodiment, the shallow slots 24A are dimensioned to accept the second and third regions of the web 26, while the deep slots 24B are dimensioned to accept the second region (opposing tabs 27) of the web 26. The slots 24A and 2B are continuous, and form an L-shaped channel in each round 12, 14, 16, 18, 20, and 22.

It will be noted from FIGS. 1A and 1B that the tabs 27 straddle the abutments 30 between the ends of the various rounds (i.e. between 14 and 14, 14 and 16, 18 and 20, 20 and 22), and that the tabs extend all the way through to the surface of the round into which it extends.

Exemplary dimensions for the various features components of the embodiment shown in FIGS. 1A and 1B are shown in FIG. 10. It will be noted that the joins of the present invention have been used to lengthen the span of a 2200 mm composite timber joist to a more useful 3600 mm by the addition of two 700 mm rounds to each end.

Figure 2A:
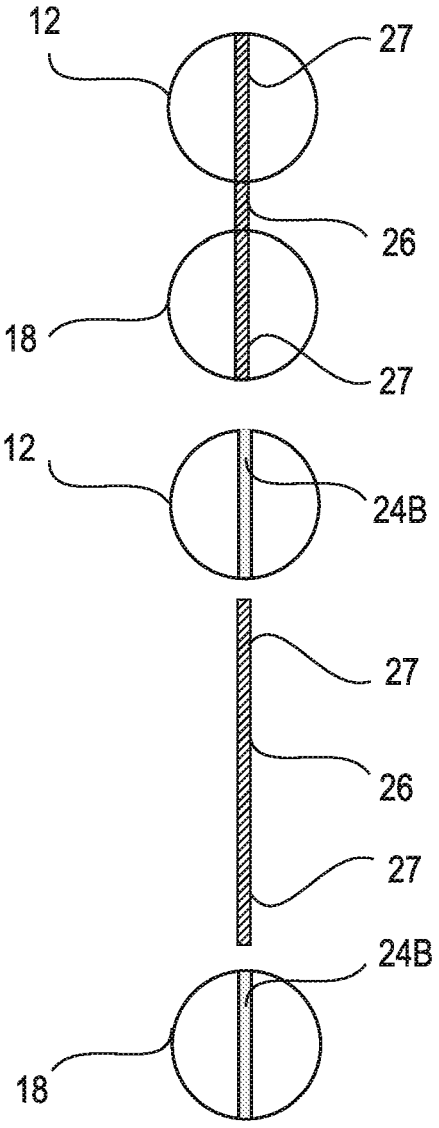
FIG. 2A shows a diagram of the section marked X-X' of FIG. 1, demonstrating the circular geometry of the peeler cores, and the planar nature of the web. The section X-X' is taken through a section of the composite timber joist including a widened region of the web (in this embodiment comprised of an upwardly extending tab and a downwardly extending tab) which inserts into slots that completely bisect the peeler cores.
Figure 2B:
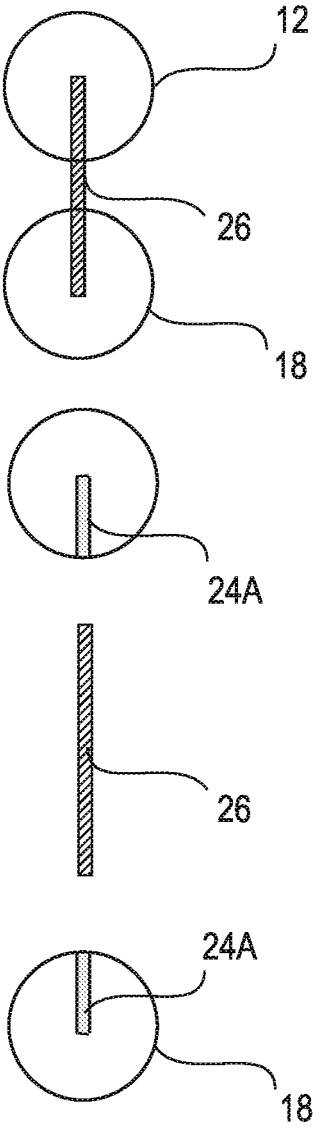
FIG. 2B is the section Y-Y' taken through a section of the composite timber joist which does not comprise a widened region of the web.

The relative sizes of the web regions, the slots into which the web regions insert, and the rounds are more clearly shown in the cross-sectional views of FIGS. 2A and 2B. FIG. 2A is a view through a region of the web 26 having tabs 27. In the assembled view (at the top of the page) it can be seen that the slot 24B completely bisects both rounds 12 and 18. FIG. 2B is a cross-sectional view through a region of the web 26 which does not comprise a tab, and it will be appreciated that the web 26 extends only about 50% into the flange.

Figure 3A:
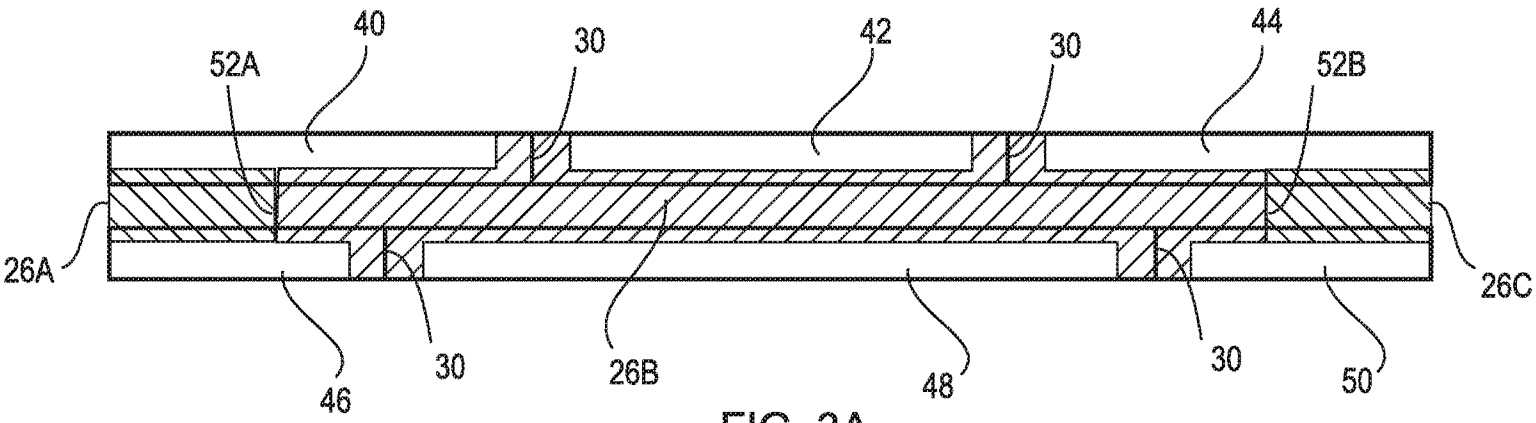
FIG. 3 shows diagrams of a composite timber joist fabricated from six timber rounds, all laminated together using joins of the present invention. Distinct from the embodiment of FIGS. 1 and 2, the embodiment of FIG. 3 is configured such that the widened regions (tabs) of the web are staggered. Furthermore, webs devoid of any widened region are disposed at the ends of the joist.
FIG. 3C shows exemplary dimensions of the embodiments shown in FIGS. 3A and 3B.
Figure 3B:
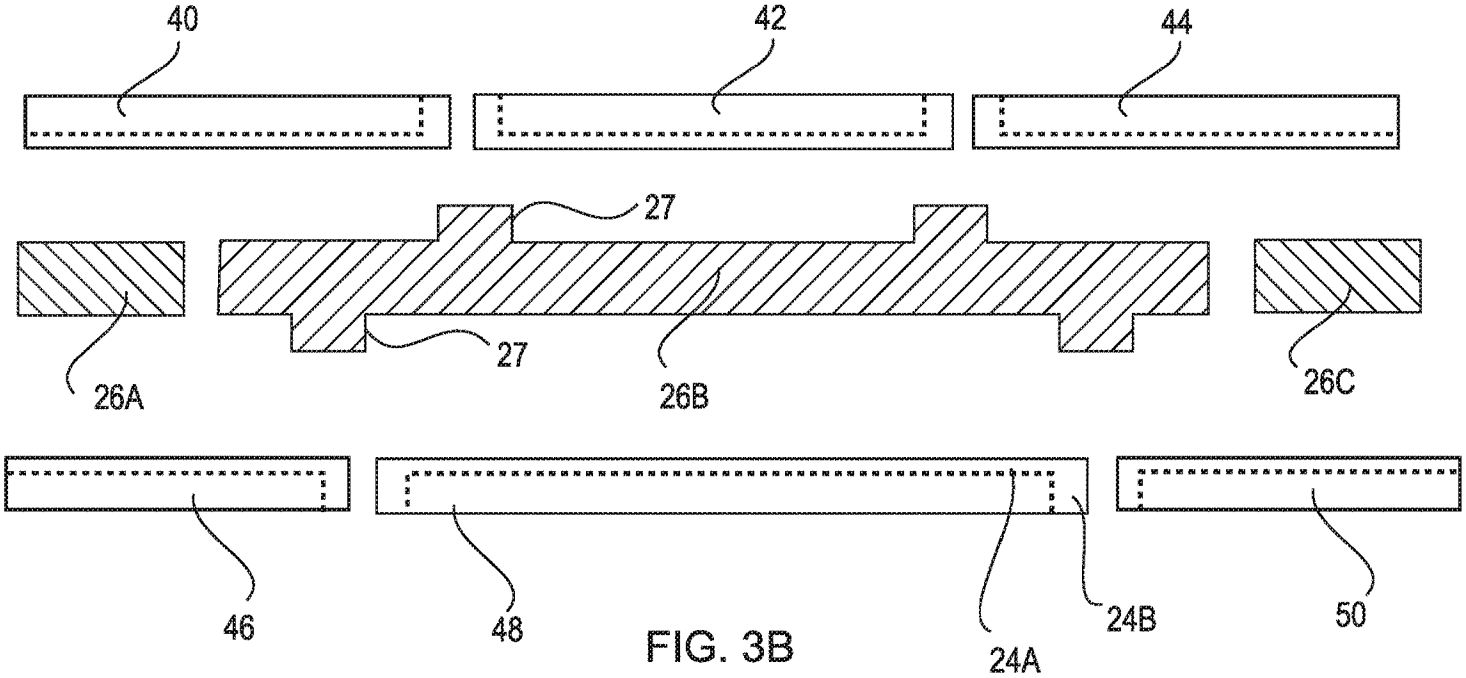

FIGS. 3A and 3B show an embodiment whereby the web 26 is not unitary, comprising three segments (26A, 26B and 26C), the segments abutting at the lines 52A and 52B. This embodiments allows for the use of shorter lengths of ply, thereby improving economy. The segments may be joined at or about the abutment line by use of an adhesive and/or fastener(s). In one embodiment, the abutting ends have two pieces of ply disposed on either side with adhesive and screws used to secure the components together.

It is generally preferred to avoid such abutments, and to use a unitary web wherever possible. To that end, oriented strand board (OSB) is an exemplary cost-effective material that may be used to fabricate the web.

It will be further noted that the tabs 27 are staggered, and accordingly the end joins between rounds are also staggered. By this arrangement, any potential points of failure (being the end joins between rounds, and the end joins between web segments) are not aligned thereby lowering the possibility of failure of the entire joist.

Figure 3C:
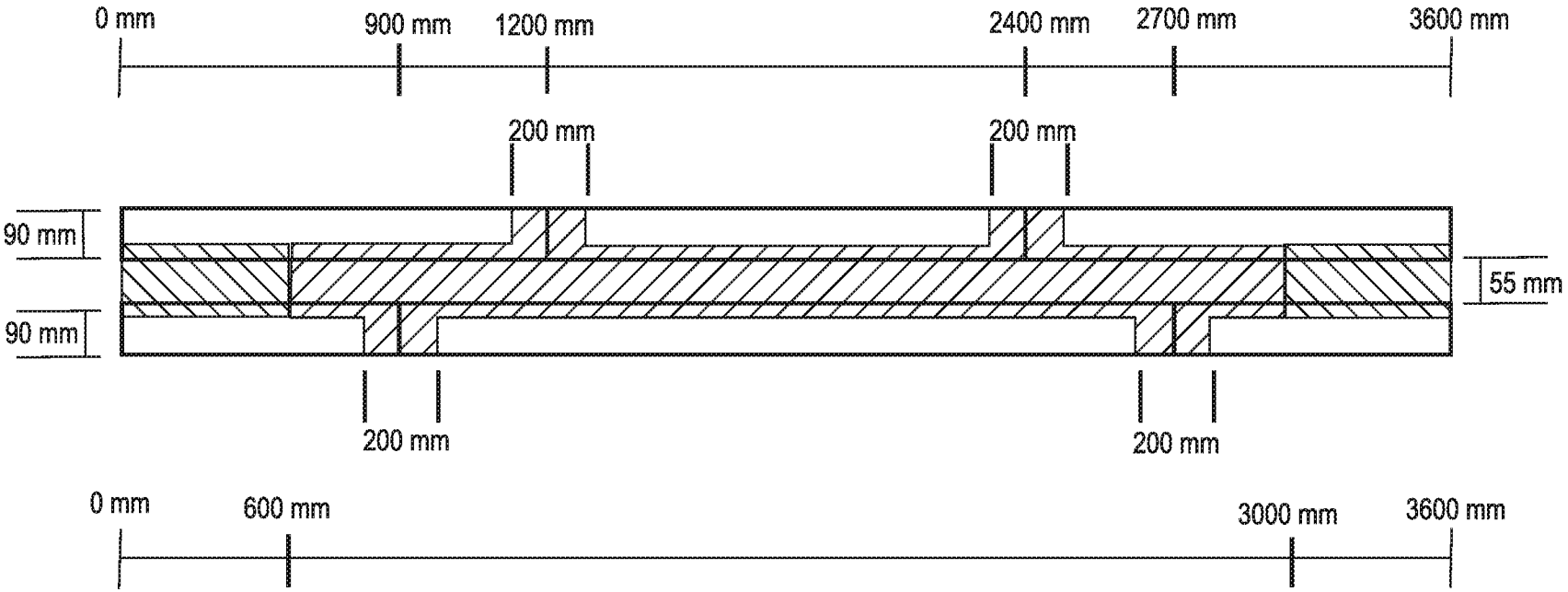

Turning to FIG. 3C, it will be noted from the dimensions that a maximum length round of 2200 mm is used (the lower central round marked 48 in FIG. 3B), which is end joined to rounds of length 700 mm each (rounds 46 and 50 marked in FIG. 3B). The three rounds which comprise the upper part of the joist (marked 40, 42 and 44 in FIG. 3B) are 1200 mm each.

In total, a joist of 3600 mm span is created from a series of small lengths of timber round.

Figure 4A:
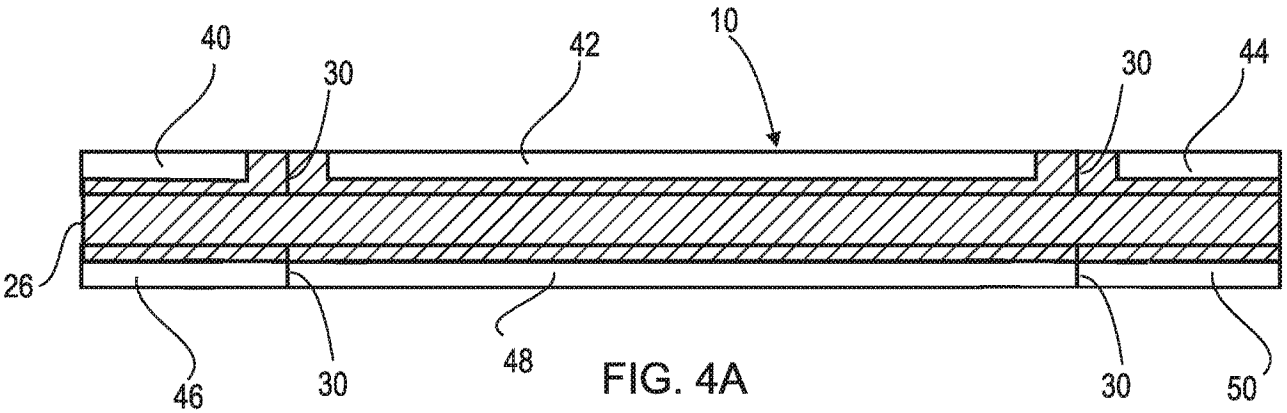
FIG. 4A is the assembled timber joist, with FIG. 4B being a partially exploded view.
Figure 4B:
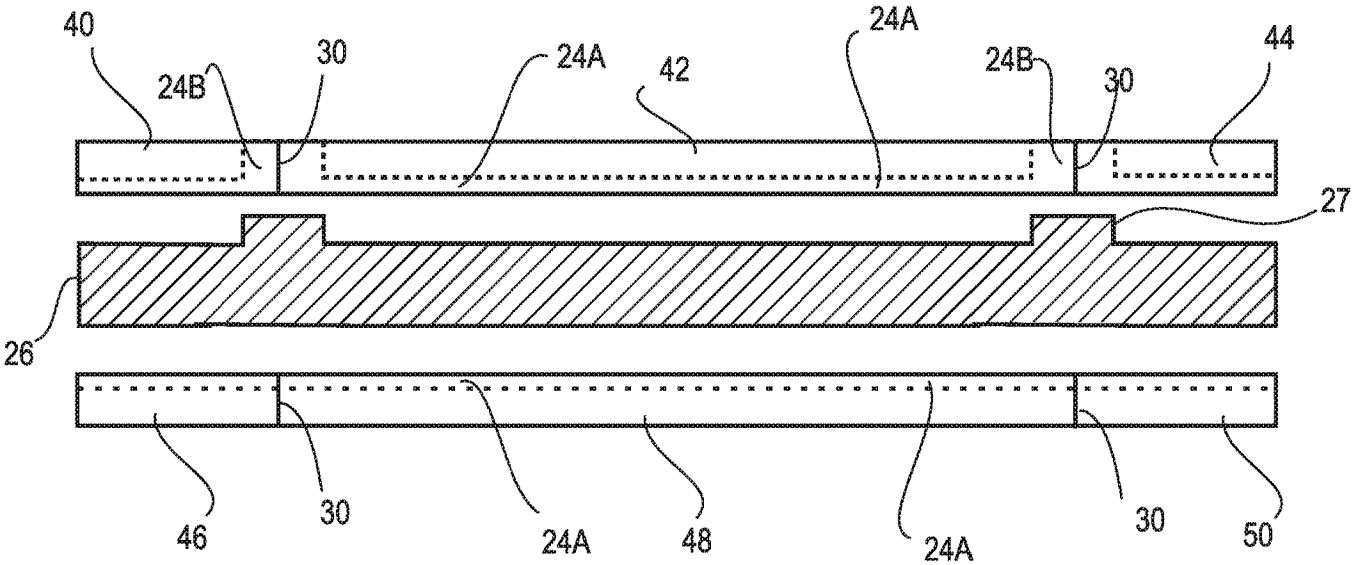
FIG. 4 shows diagrams of a composite timber member similar to that shown in FIG. 1, however with the widened portion of the web consisting of only upwardly extending tabs.

With reference to FIGS. 4A and 4B there is shown an embodiment having a web 26 with tabs 27 extending only form the upper side. This embodiment is less preferred than others disclosed in this section given the possibility of failure along the lines of abutments between rounds 46 and 48, and 48 and 50 due the absence of a web tab straddling those abutments. Such embodiments will be useful nevertheless for lower load situation, and in any event till provide the advantage of providing a longer span joist.

Figure 5A:
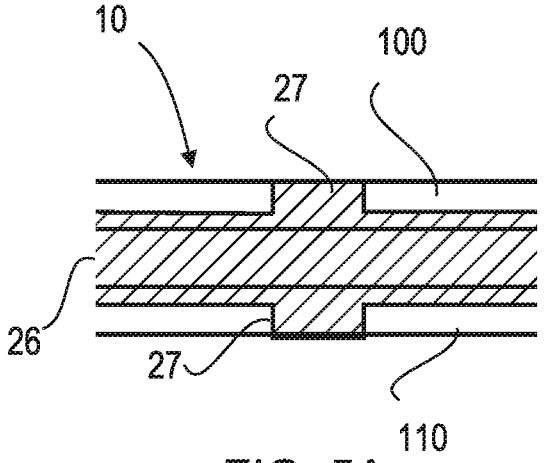
FIG. 5A is the assembled timber joist, with FIG. 5B being a partially exploded view.
Figure 5B:
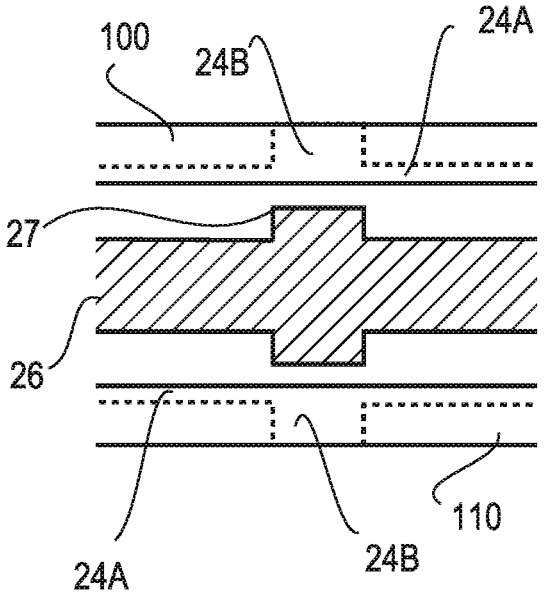
FIG. 5 shows diagrams of a composite timber member having no joins. The widened portion of the web consisting of upwardly and downwardly extending tabs which act to improve strength of the composite joist.

As discussed elsewhere herein, webs having a widened region are useful in laminating timber members together but without any involvement of an end join. An exemplary embodiment is shown at FIGS. 5A and 5B detailing the lamination of an upper round 100 and a lower round 110 with a web 26 having opposed tabs 27. The tabs 27 provide a region of greater resistance to deformation of the overall joist. The tabs may be placed at regular intervals along a joist, or only at a central region, or only at region(s) where higher loads are expected to bear.

Webs may be used in a single joist for both purposes of end joining timber members (as shown in FIGS. 1 through 4), and also increasing the overall strength of the joist (as shown in FIG. 5).

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

It will be appreciated that in the detailed description and the description of preferred embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby expressly incorporated into this description, with each claim standing on its own as a separate embodiment of this invention.

Furthermore, while some embodiments described herein include some but not other features included in other embodiments, combinations of features of different embodiments are meant to be within the scope of the invention, and from different embodiments, as would be understood by those in the art. For example, in the claims appended to this description, any of the claimed embodiments can be used in any combination.

In the description provided herein, numerous specific details are set forth. However, it is understood that embodiments of the invention may be practiced without these specific details.

In other instances, well-known methods, structures and techniques have not been shown in detail in order not to obscure an understanding of this description.

It is not represented that any particular embodiment of the invention disclosed herein has all advantages described herein, or indeed any advantage described herein.

The invention claimed is:

1. A join for end-joining elongate timber flanges, the join comprising:

an elongate planar web having a longitudinal axis, an upper portion running along the longitudinal axis, and a lower portion running along the longitudinal axis;

the elongate planar web having, in order running along the longitudinal axis, a first region, a second region and a third region, the second region having a greater height than the first and third regions;

a first elongate timber flange having a slot engaging the upper portions of the first and second regions of the planar web;

a second elongate timber flange having a slot engaging the upper portions of the second and third regions of the planar web;

wherein the lower portion of the planar web extends beyond the first and second elongate timber flanges so as to provide an engagement portion; and a third elongate timber flange engaging the engagement portion of the elongate planar web.

2. The join of claim 1 wherein the second region is formed so as to provide a tab.

3. The join of claim 1 wherein the second region extends greater than about 50% into the first and/or second elongate timber flanges.

4. The join of claim 3 wherein the second region extends substantially completely through the first and/or second elongate timber flanges.

5. The join of claim 1 wherein the first region extends at least about 10% into the first elongate timber flange, and the second region extends at least about 10% into the second elongate timber flange.

6. The join of claim 1 wherein the first region extends up to about 50% into the first elongate timber flange, and the second region is extends up to about 50% into the second elongate timber flange.

7. The join of claim 1 wherein the first and second elongate timber flanges each has a longitudinal axis, and the longitudinal axes of the planar web, the first elongate timber flange and the second elongate timber flange are substantially parallel.

8. The join of claim 7 wherein the first and second elongate timber flanges each has an end and the respective ends are opposing, and the opposing ends abut within the second region of the elongate planar web.

9. The join of claim 8 wherein the abutment is along a substantially central point of the second region of the elongate planar web.

10. The join of claim 1 wherein the slot is dimensioned so as to make close connection with the elongate planar web.

11. The join of claim 1, wherein the third elongate timber flange has a slot engaging the engagement portion of the planar web.

12. The join of claim 11 wherein a substantially central region of the third timber flange is coincident with a substantially central point of the second region of the elongate planar web.

13. The join of claim 11 wherein the planar web extends at least about 10% into the third timber flange.

14. The join of claim 11 wherein the planar web extends up to about 50% into the third timber flange.

15. The join of any claim 11 wherein the first timber flange does not abut the third timber flange, and the second timber flange does not abut the third timber flange so as to leave a portion of the elongate planar flange exposed.

16. The join of claim 15 wherein the area of the exposed portion of the elongate planar flange is up to about 50% of the total area of the elongate planar flange.

17. The join of claim 1 wherein the first timber flange and the second timber flange are substantially circular in cross-section.

18. The join of claim 17 wherein the first timber flange and the second timber flange are timber rounds or peeler cores.

19. The join of claim 1 wherein the elongate planar web is fabricated from a timber ply material.

* * * * *